US007540172B2

(12) United States Patent
Julkowski et al.

(10) Patent No.: US 7,540,172 B2
(45) Date of Patent: Jun. 2, 2009

(54) APPARATUS FOR ADJUSTABLE BEAD RETENTION ON BRACELETS AND NECKLACES

(75) Inventors: Jeff Julkowski, New York, NY (US); Troy Sergent, Winthrop, ME (US)

(73) Assignee: Chamilia, LLC, Minneapolis, MN (US)

( * ) Notice: Subject to any disclaimer, the term of this patent is extended or adjusted under 35 U.S.C. 154(b) by 0 days.

(21) Appl. No.: 11/132,720

(22) Filed: May 19, 2005

(65) Prior Publication Data

US 2006/0260300 A1 Nov. 23, 2006

(51) Int. Cl.
*A44C 5/00* (2006.01)
*A44C 25/00* (2006.01)

(52) U.S. Cl. ..... 63/3; 63/3.1; 63/38; 63/40

(58) Field of Classification Search ..... 63/1.11, 63/1.18, 3, 3.1, 3.2, 4, 38–40, 37, 35, 5.1, 63/19

See application file for complete search history.

(56) References Cited

U.S. PATENT DOCUMENTS

| | | | | | |
|---|---|---|---|---|---|
| 878,122 | A | * | 2/1908 | Costello | 63/4 |
| 1,124,518 | A | * | 1/1915 | Qvarnstrom | 24/115 H |
| 1,578,940 | A | * | 3/1926 | Wacha | 24/116 A |
| 2,462,425 | A | * | 2/1949 | Pratt et al. | 63/3 |
| 2,540,369 | A | * | 2/1951 | Hume | 446/124 |
| 3,168,768 | A | * | 2/1965 | Bohlinger et al. | 24/116 A |
| 3,181,217 | A | * | 5/1965 | Bohlinger et al. | 24/116 A |
| 3,685,284 | A | | 8/1972 | Taubner, Jr. | |
| 3,983,716 | A | | 10/1976 | Kuhn | |
| 4,237,702 | A | | 12/1980 | Caverly | |
| 4,321,804 | A | * | 3/1982 | Borofsky et al. | 63/3.2 |
| 4,527,316 | A | | 7/1985 | Murphy | |
| 4,530,221 | A | * | 7/1985 | Weinberg | 63/3.2 |
| 4,551,993 | A | | 11/1985 | Nagahori | |
| 4,562,704 | A | | 1/1986 | Benedek et al. | |
| 4,628,708 | A | | 12/1986 | Ivey | |
| 4,754,534 | A | * | 7/1988 | Helwick | 24/543 |
| 4,907,322 | A | | 3/1990 | Kanno | |
| 4,974,428 | A | | 12/1990 | Yoda | |
| 5,214,940 | A | * | 6/1993 | Capifali | 63/21 |
| 5,279,132 | A | | 1/1994 | Swaim | |

(Continued)

OTHER PUBLICATIONS http://www.chicogifts.com/.*

(Continued)

*Primary Examiner*—Victor Batson
*Assistant Examiner*—David C Reese
(74) *Attorney, Agent, or Firm*—Verrill Dana, LLP; Chris A. Caseiro

(57) ABSTRACT

A modifiable jewelry piece including a strand and one or more adjustable retainers. The adjustable retainers include an interior structure configured to establish a frictional engagement with the outer surface of the strand. The jewelry piece wearer may select the location of the placement of the adjustable retainer anywhere along the length of the strand. The interior structure may be a solid or semi-solid having high surface tension or rough surface profile. The interior structure may alternatively be a mechanical capturing device. The jewelry piece also includes one or two end connectors having a slot and flange arrangement for easy passage of beads thereover only when desired. The flange and slot are arranged for alignment with threaded and flanged beads.

12 Claims, 4 Drawing Sheets

U.S. PATENT DOCUMENTS

| | | | | |
|---|---|---|---|---|
| 5,398,391 | A * | 3/1995 | Yokochi | 24/616 |
| 5,440,900 | A | 8/1995 | White | |
| 5,528,909 | A * | 6/1996 | Tonakawa | 63/3 |
| 5,588,190 | A * | 12/1996 | Sato | 24/682.1 |
| 5,590,546 | A * | 1/1997 | Hector | 63/38 |
| 5,664,291 | A * | 9/1997 | Stoller | 24/3.3 |
| 5,687,585 | A * | 11/1997 | Ferrell | 63/21 |
| 5,722,260 | A * | 3/1998 | Mangano | 63/3.1 |
| 5,881,736 | A * | 3/1999 | Turner et al. | 132/200 |
| 6,449,810 | B1 * | 9/2002 | Kuwayama | 24/115 H |
| 6,557,376 | B2 * | 5/2003 | Pratt | 63/3 |
| 6,675,611 | B2 * | 1/2004 | Hunter | 63/3.1 |
| 6,722,036 | B2 | 4/2004 | Pratt | |
| 6,901,771 | B2 * | 6/2005 | Ooide | 63/26 |
| 7,007,507 | B2 * | 3/2006 | Enevoldsen | 63/3.1 |
| 2001/0054299 | A1 | 12/2001 | White | |
| 2002/0139141 | A1 | 10/2002 | Kuwayama | |
| 2003/0019242 | A1 | 1/2003 | White | |
| 2003/0136149 | A1 * | 7/2003 | Logan et al. | 63/35 |
| 2004/0144131 | A1 * | 7/2004 | Enevoldsen | 63/3 |
| 2005/0076673 | A1 * | 4/2005 | Oliver et al. | 63/1.11 |

OTHER PUBLICATIONS http://www.chamilia.com.*
http://www.icsc.org/srch/sct/sct0304/page64.php?region=.*
http://web.archive.org/web/*/http://www.italiancharmshop.com/catalog/chamilia_brac.shtml.*
http://web.archive.org/web/*/http://www.terryivory.com/chamilia.htm.*
http://www.dollsandducks.com/chamilia_bead_jewelry/clips.htm.*
http://www.dollsandducks.com/beads/chainsstyles.htm.*
http://www.chamiliabeadsbymac.com/howitworks.html.*
http://www.chamiliabeadsbymac.com/explainfreedom.html.*
Screen "Trollbeads", (2004), http://www.lundtrading.com, (1 page).
Lund Trading Advertisement, "Introducing a More Elegant Concept in Scandanavian Designed Jewelry," Publication unknown, Date unknown, (1 page).
Pandora Jewelry Advertisement, "The original interchangeable jewelry," Publication unknown, 2000 (1 page).

* cited by examiner

APPARATUS FOR ADJUSTABLE BEAD RETENTION ON BRACELETS AND NECKLACES

BACKGROUND OF THE INVENTION

1. Field of the Invention

The present invention relates to bracelets and necklaces. More particularly, the present invention relates to bracelets and necklaces arranged to enable a wearer to change beads and adjust the positioning of beads thereon. Still more particularly, the present invention relates to bracelets and necklaces including adjustable means for bead position retention. The present invention also includes an improved end connector arrangement to facilitate bead placement on bracelets and necklaces.

2. Description of the Prior Art

Jewelry bracelets and necklaces of the type having two end connectors or clasps, allow the wearer to place the jewelry around the wrist or neck, secure it in position, and be reasonably assured that it will not pass over the hand or head. Such jewelry is generally formed as a strand, chain or band with the end connectors or clasps at opposing ends thereof. The end connectors may be joined together to retain the jewelry in position, and then disconnected from one another to allow removal of the jewelry from the wearer. In generally, most can be categorized as threaded, hook-and-loop, or spring-loaded latches with loops. Some jewelry end connectors or clasps are easier to use than others.

Bracelets and necklaces may or may not include supplemental pieces fixedly or movably positioned thereon. For example, the bracelet may be a charm bracelet with links onto which charms are affixed, or the necklace may include a precious stone attached to a loop that may slide along the necklace chain. While charm bracelets and necklaces including slidable pieces have been known for many years, there has been growing interest in modifiable jewelry, and bracelets in particular, configured to permit the wearer to select supplemental pieces of interest to be applied to the jewelry, and add and remove such pieces as desired.

Modifiable bracelets as originally made commercially available simply involved a strand, string, or chain having one or both of the end connectors sized to permit the supplemental piece, such as a bead with some sort of port, to pass thereover. Upon the joining of the two end connectors, the bead would be retained on the strand, but able to move freely around the strand. In the event one of the end connectors was sized larger than the internal dimension of the bead port, the bead was able to move freely about the strand until reaching that larger end connector, at which it would be blocked from further forward movement. The number and size of the beads applied by the wearer to the strand was only limited by the internal dimensions of the bead port, and the wearer's interest and capability to add beads to the strand.

Interest in the modifiable bracelets may have been dampened to an extent as a result of the concern that, absent application of removable beads to cover the entire length of the strand, the beads move to undesired positions on the strand. One or more beads may gravitate to the underside of the wearer's wrist, or a favorite bead may not be observable from a certain vantage point. It was soon realized that there were limitations associated with the modifiable bracelets first made commercially available. Specifically, it was determined that the modifiable bracelets allowed wearers to add and remove beads from a strand as desired, but did not allow the wearers to regulate the positioning of the beads on the strand.

Recent attempts to solve this limitation in modifiable bracelets (and necklaces) have met with some success. One type of modifiable bracelet is a strand with end connectors and one or more fixed retainer bases spaced along the length of the strand. Each retainer base is designed to hold a removable retainer thereon. Beads with ports may be passed over either or both end connectors and the retainer bases. Once one or more beads are placed in a desired region of the strand, the removable retainer is placed on the retainer base. The retainer is sized bigger than the bead port such that a bead may not be passed over it. The retainer(s) thereby prevent bead movement beyond the location of the retainer. Beads may, however, move slidingly along the strand between retainers and/or, dependent upon the end connector design, between a retainer and an end connector.

There are several limitations associated with a modifiable bracelet or necklace including the fixed retainer base and removable retainer as described. The fixed retainer base forces the wearer to place the retainer only at the position of the base, and thereby restricts the bead placement. That is, the wearer is not permitted to define retainer placement and, thus, bead placement. The modifiable bracelets that have been observed include either threaded or unthreaded retainer bases. The threaded retainer bases require an internally threaded retainer, while the unthreaded retainer bases interface with hinged retainers. The threaded base-retainer interfaces force the wearer to go through a substantial amount of work just to put that portion of the bracelet together. The interface between the unthreaded base and the hinged retainer is a loose one and makes for undesirable play of the retainer on the strand.

Another limitation of the existing modifiable bracelets is the end connector. The end connectors of the existing modifiable bracelets are threaded. They force the wearer to use only internally threaded beads, or beads with large bead ports. The threaded end connectors force the wearer to go through the effort of threading internally threaded retainers thereover before reaching a retainer base. They also force the wearer to thread internally threaded beads thereover before passing to a location of interest between fixed retainer bases and/or end connectors. The effort required to thread retainers and/or beads reduces the commercial value of such modifiable bracelets.

Therefore, what is needed is a modifiable bracelet, necklace, or other removable jewelry item configured to enable a wearer to easily add and remove supplemental pieces to the item strand. What is also needed is such a modifiable jewelry item configured to enable a wearer to position selectively on the strand one or more retainers to retain one or more supplemental pieces on the strand. Further, what is needed is such a modifiable jewelry item including end connectors suitable for ease of passage of retainers and/or supplemental pieces thereover.

SUMMARY OF THE INVENTION

It is an object of the present invention to provide a modifiable bracelet, necklace, or other removable jewelry item configured to enable a wearer to easily add and remove supplemental pieces to the item strand. It is also an object of the present invention to provide such a modifiable jewelry item configured to enable a wearer to position selectively on the strand one or more retainers to retain one or more supplemental pieces on the strand. Further, it is an object of the present invention to provide such a modifiable jewelry item including end connectors suitable for ease of passage of retainers and/or supplemental pieces thereover.

These and other objects are achieved with the present invention, which is a modifiable jewelry item including one or more adjustable retainers. The adjustable retainer may be a unitary piece configured to slide onto the strand, chain, or band of the jewelry item. Alternatively, the adjustable retainer may be formed of two parts, possibly hinged, and arranged to be placed about the strand and removably clasped in place thereon. The adjustable retainer of the jewelry item includes an interior structure that keeps the retainer in a selectable position on the strand.

The interior structure is configured to establish high-friction contact between the retainer and the strand. The friction between the interior of the retainer and the strand may be selectable and a function of the details of the interior structure and the outer surface of the strand. The interior structure may be arranged by itself, or in combination with the arrangement of the outer surface of the strand, to be frictional enough to require substantial force to dislodge the adjustable retainer from its particular position on the strand. Alternatively, the interior structure may be arranged to allow relative ease of movement along the strand, but with enough friction that unintended movement of the adjustable retainer is unlikely to occur. Nevertheless, the interior structure is arranged to cover substantially all of the inside dimensions of the adjustable retainer such that substantially all of the interior structure is in contact with the stand when the retainer is positioned on the stand. The arrangement of the interior structure as well as its frictional characteristics substantially restrict movement of the retainer along the strand and rotational movement of the retainer around the strand when the retainer is positioned on the strand.

The interior structure of the adjustable strand may be formed of a viscoelastic material with high surface tension, or it may be a metallic or nonmetallic material with rough surface characteristics. The interior structure may also be formed with one or more grabbing elements, such as hooks, pins, springs, or the like, but not limited thereto, that may grab the outer surface of the strand. Additionally, the outer surface of the strand may be formed with rough surface characteristics and/or grabbing elements to increase the friction between that surface and the interior structure of the adjustable retainer. Alternatively, the strand may be relatively smooth, with the frictional contact provided primarily by the interior structure of the adjustable retainer.

The arrangement of the retainer including an interior structure designed to establish frictional contact with the outer surface of the strand enables fabrication of a strand without special need for a fixed component designed to engage the retainer. As a result, the cost to fabricate the strand may be reduced. Further, the retainer may be positioned wherever desired along the length of the strand and is not limited to a few locations defined by placement of the fixed component. This enables the wearer to position beads anywhere of interest along the strand and in any combinations. Still further, the retainer preferably fits relatively snugly thereby avoiding loose play on the strand. That is, the interior structure is arranged to substantially restrict movement of the retainer along the strand and rotational movement of the retainer around the stand when the retainer is positioned on the strand. The retainer is also easily placeable on the strand, eliminating the effort required to screw the retainer over and on fixed elemental and end connectors.

The modifiable jewelry of the present invention further includes one or two convenient end connectors. The end connector or connectors of the modifiable jewelry of the present invention include a body with one or more slots arranged thereon. The body of the end connector is preferably sized to have an exterior dimension or dimensions less than the dimension or dimensions of the interior ports of one or more beads to be positioned on the strand, band, or chain of the jewelry item. In particular, the connector body may have a smaller exterior dimension and a larger exterior dimension, both sized to enable bead ports to pass thereover, but only when the bead and end connector are aligned in a particular way. The bead cannot passed over the end connector without the required alignment. This arrangement eliminates the time consumption associated with screwing a bead over an end connector, but ensures that the end connector will capture the bead on the strand.

The modifiable jewelry of the present invention, including either or both of the adjustable retainer and the convenient end connectors, is an improvement over existing related jewelry. The improvements provide the wearer with more options and less difficulty in creating customized jewelry arrangements. These and other advantages and features of the invention will become more apparent upon review of the following detailed description, the accompanying drawings, and the appended claims.

DETAILED DESCRIPTION OF THE PREFERRED EMBODIMENTS OF THE INVENTION

Figure 1:
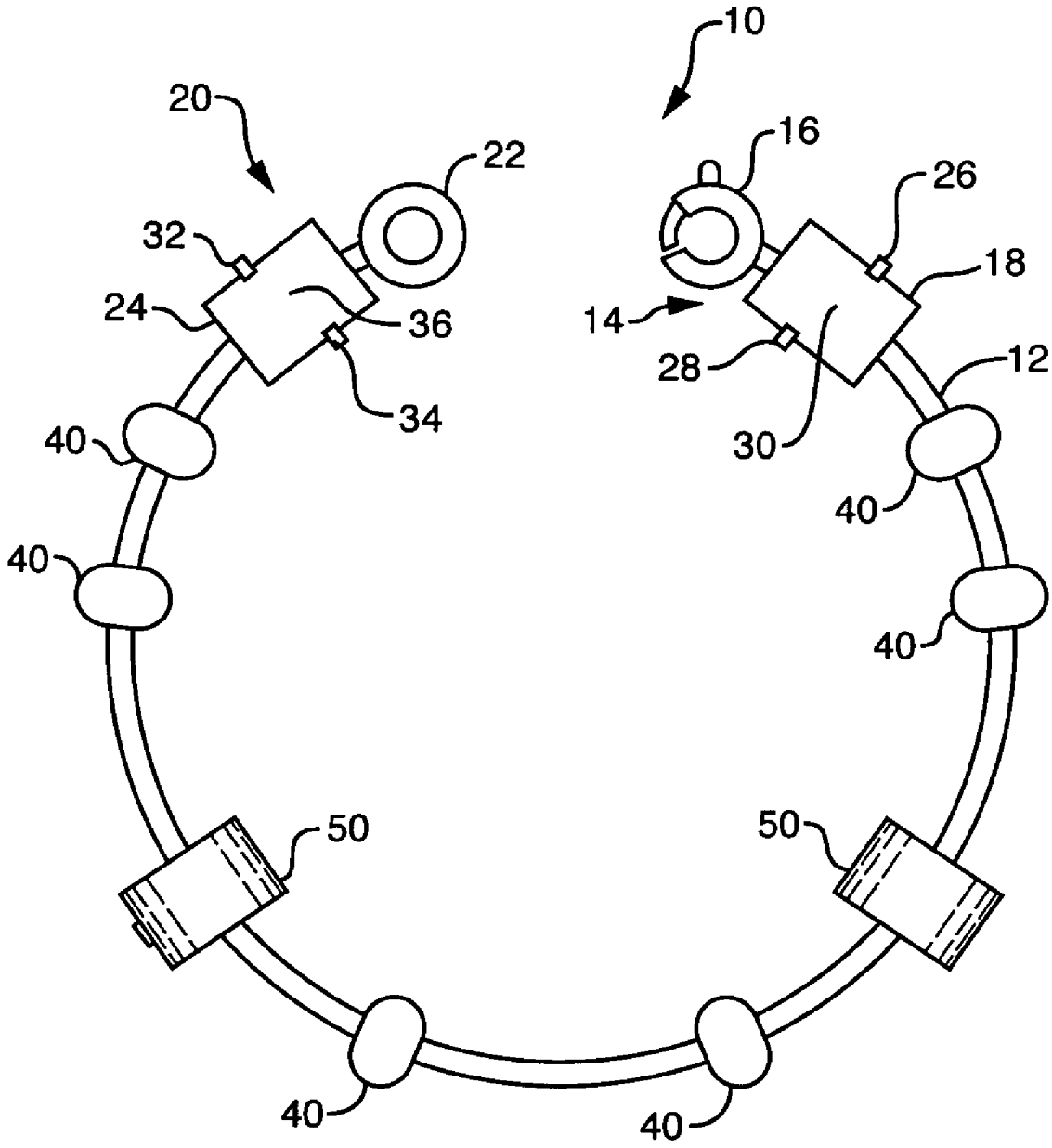
FIG. 1 is a top view of the modifiable jewelry of the present invention, showing a strand with a plurality of adjustable retainers, two end connectors, and a plurality of beads.

A modifiable jewelry piece 10 of the present invention is shown in FIG. 1. The jewelry piece 10 may be used as a bracelet, an anklet, a necklace, or an earring, for example. The jewelry piece 10 includes a strand 12, a first end connector 14, a second end connector 20, and one or more adjustable retainers 50. The jewelry piece 10 is arranged to enable a wearer to place one or more beads 40 thereon at selectable locations along the length of the strand 12.

The strand 12 may be fabricated of a metallic material or a nonmetallic material. The strand 12 may be formed of silver, gold, plastic, rubber or leather, or of combinations of materials, for example. The strand may be solid, porous or hollow. The surface of the strand 12 may be relatively smooth having a relatively low surface coefficient of friction. Alternatively, the surface of the strand 12 may have a relatively high surface coefficient of friction. An interior surface of the adjustable retainer 30 is arranged to make contact with the surface of the strand 12 in a manner that establishes frictional contact between the two components so that movement of the adjustable retainer 30 on the strand 12 is minimized.

With continuing reference to FIG. 1, the first end connector 14 includes a first loop 16 and a first end interface 18 fixedly engaged to a first end of the strand 12. The second end connector 20 includes a second loop 22 and a second end interface 24 fixedly engaged to a second end of the strand 12. The first loop 16 and the second loop 22 are configured for releasable engagement with one another in a manner that completes the looping of the strand 12 in an enclosing arrangement. For example, the first loop 16 may include a spring-loaded enclosure that may be opened to allow the first loop 16 to loop on to the second loop 20, as is well know to those skilled in the art of loop jewelry enclosure mechanisms.

The first end interface 18 of the first end connector 14 includes a first bead blocker 26 preferably formed of a first flange 28 and a first slot 30. The second end interface 24 of the second end connector 20 includes a second bead blocker 32 preferably formed of a second flange 34 and a second slot 36. The arrangements of the first end interface 18 and the second end interface 24 will be described in greater detail in view of FIGS. 6 and 7. However, it is to be noted that the first end interface 18 and the second end interface 24 are configured to enable one or more beads 40 to pass thereover, but only when the bead 40 and either one of the end interfaces 18/24 is aligned to the bead 40 in a particular way. The bead 40 cannot passed over the end interface 18/24 without the required alignment. This arrangement allows the wearer to place the bead 40 on the strand 12, or to remove it from the strand 12, relatively quickly and easily.

It is to be understood that the modifiable jewelry piece 10 of the present invention may be operative with only one of the end interfaces. For example, second end connector 20 may be formed only with the second loop 22 but without second interface 24 such that the first loop 16 and second loop 22 are engageable with one another. However, without the second end interface 24, beads 40 may only be barred from passing over the second end connector 20 by placing one or more adjustable retainers 50 between any such beads 40 and the second end connector 20.

With continuing reference to FIG. 1, a wearer may use the modifiable jewelry piece 10 in the following manner. Prior to placing any beads 40 on, or removing any beads 40 from, the strand 12, the user must confirm that the first loop 16 and the second loop 22 are disengaged from one another. The wearer may select one or more locations along the length of the strand 12 on to which apply one or more adjustable retainers 50. The one or more adjustable retainers 50 may then be removably applied to the strand 12 where desired. Two types of adjustable retainers 50 will be described with respect to FIGS. 2 and 3, one a unitary retainer placeable about the strand 12, and the other a hinged retainer that may be clamped about the strand 12. Each includes an interior structure constructed to establish a frictional fit to the surface of the strand 12. Examples of suitable interior structures of the adjustable retainers 50 are described and shown in FIGS. 4 and 5. One or more beads 40, each having an interior port, may be passed over one of the end connectors 14/20 of the jewelry piece 10 and positioned between adjustable retainers 50 or between an adjustable retainer 50 and an end connector 14/20. Hinged adjustable retainers 50 may be added or removed as desired while beads 40 reside on the strand 50. Unitary adjustable retainers 50 may be repositioned on the strand 12 while beads 40 are also on the strand 12.

Figure 2:
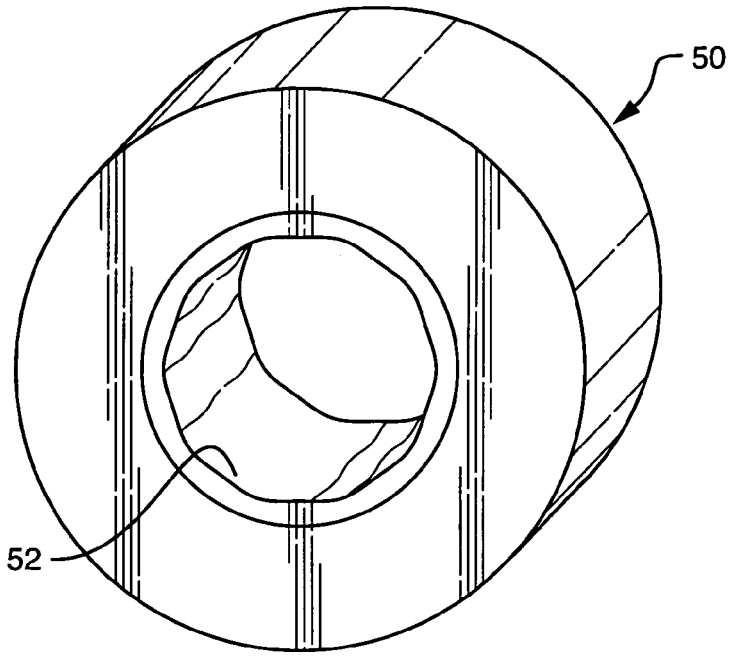
FIG. 2 is a perspective view of a unitary adjustable retainer with frictional interior structure.

As illustrated in FIG. 2, a first embodiment of the adjustable retainer 50 is a unitary annular ring or bushing fabricated of a selectable material. The unitary adjustable retainer 50 includes an interior structure 52 that may cover a portion or substantially all of the inside dimensions of the adjustable retainer 50. The interior structure 52 is configured to enhance frictional contact between the adjustable retainer 50 and the outer surface of the strand 12. The interior structure may be configured with selectable frictional characteristics. That is, it may be formed to make movement of the adjustable retainer 50 on the strand 12 relatively difficult or relatively simple. A relatively high coefficient of friction of the interior structure 52 makes movement of the adjustable retainer 50 on the strand 12 relatively difficult and would be useful to the wearer who wishes to have little unintended movement of the adjustable retainer 50 on the strand 12. A relatively low coefficient of friction of the interior structure 52 makes movement of the adjustable retainer 50 on the strand 12 relatively easy and would be useful to the wearer who wishes to be able to adjust the position of the adjustable retainer 50 on the strand 12 with minimal effort. The interior structure 52 minimizes unintended movement of the adjustable retainer 50 on the strand 12. That is, unlike a threaded retainer of the prior device, for example, which can be rotated unintentionally until it moves off a permanent fixture of the strand, the interior structure 52 of the adjustable retainer 50 is arranged to cover substantially all of the inside dimensions of the adjustable retainer 50 such that substantially all of the interior structure 52 is in contact with the outer surface of the strand 12 when the adjustable retainer 50 is positioned on the strand 12. This arrangement of the interior structure 52 as well as its frictional characteristics substantially restrict movement of the adjustable retainer 50 along the strand 12 and rotational movement of the adjustable retainer 50 around the strand 12 when the adjustable retainer 50 is positioned on the strand 12.

Figure 3:
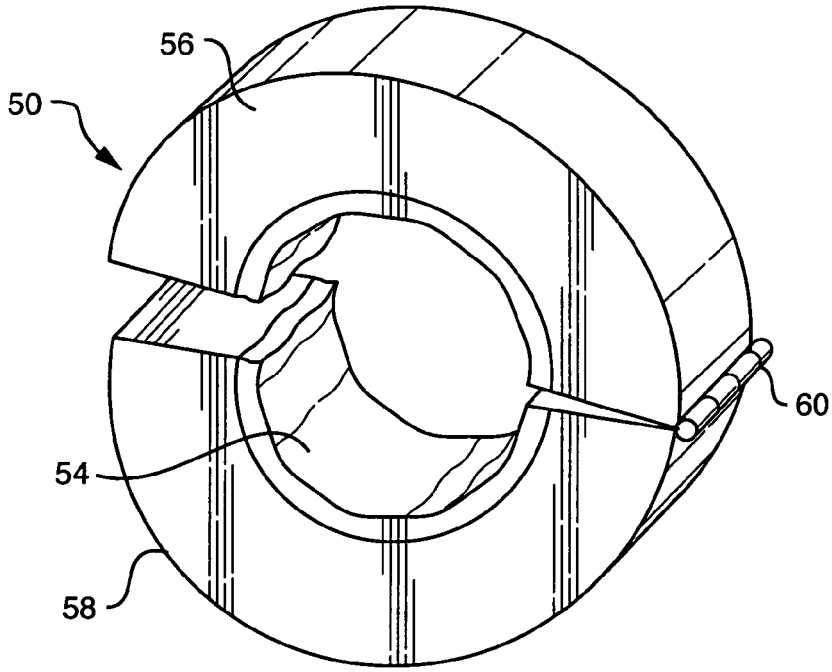
FIG. 3 is a perspective view of a hinged adjustable retainer with frictional interior structure.

As illustrated in FIG. 3, a second embodiment of the adjustable retainer 50 is a hinged annular ring or bushing fabricated of a selectable material. The hinged adjustable retainer 50 includes an interior structure 54 that may cover a portion or substantially all of the inside dimensions of the adjustable retainer 50. The hinged adjustable retainer 50 further includes a first piece 56, a second piece 58, and a hinge joint 60 hingedly connecting the two. As with the interior structure 52 of unitary adjustable retainer 50 of FIG. 2, the interior structure 54 is configured to enhance frictional contact between the adjustable retainer 50 and the outer surface of the strand 12. The interior structure may be configured with selectable frictional characteristics as described with respect the interior structure 52 of FIG. 2. The first piece 56 and the second piece 58 preferably including a latching mechanism or locking mechanism, such as a pressure fit tongue-and-groove arrangement for releasable clamping of the hinged adjustable retainer 50 of FIG. 3 on the strand 12. The hinged adjustable retainer 50 enables the wearer to change the position of the adjustable retainer 50 on the strand 12 without removing any beads 40 from the strand 50. The interior structure 54 minimizes unintended movement of the adjustable retainer 50 on the strand 12.

Figure 4:
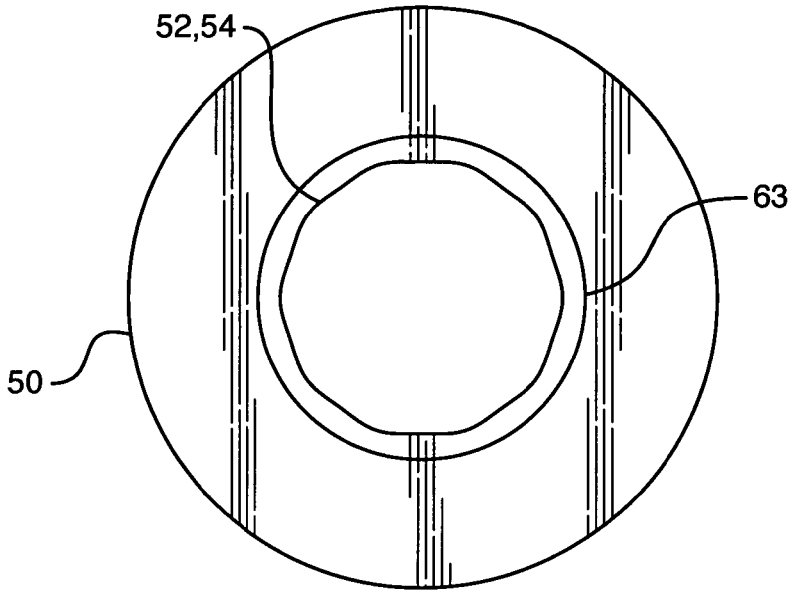
FIG. 4 is a side view of an adjustable retainer showing a first embodiment of the frictional interior structure.
Figure 5:
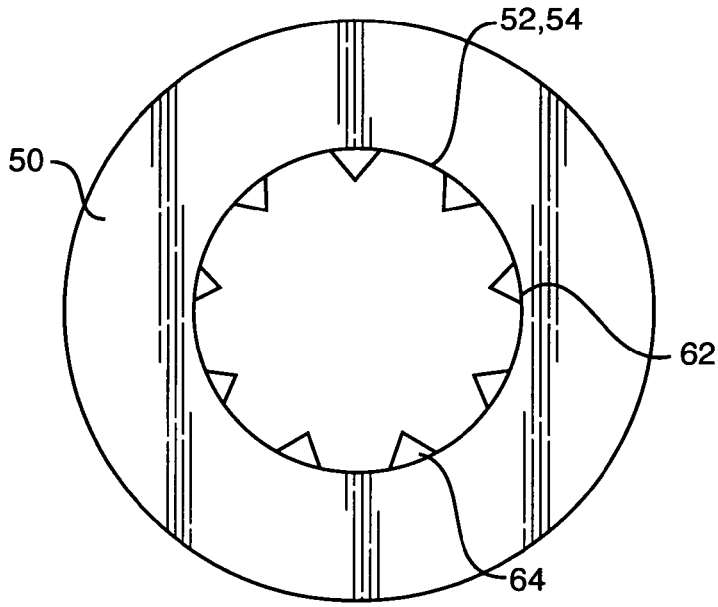
FIG. 5 is a side view of an adjustable retainer showing a second embodiment of the frictional interior structure.

As illustrated in FIG. 4, a first embodiment of the interior structure 52/54 of the adjustable retainer 50 is a solid or semi-solid material having high surface tension or a rough surface profile. As one example of such a material, the interior structure 52/54 may be a silicone rubber or gel of relatively low hardness. The material is preferably bonded or molded in place on the interior surface 62 of the adjustable retainer 50. The characteristics of the material of the interior structure 52/54 in combination with the surface characteristics of the strand 12 determine the extent of the resistance to movement of the adjustable retainer 50 on the strand 12. As illustrated in FIG. 5, a second embodiment of the interior structure 52/54 of the adjustable retainer 50 is a mechanical capturing device 64 designed to grab surface imperfections of the outer surface of the strand 12, and may be of particular effectiveness with roped or helical strands. The mechanical capturing device 64 may be pins, hooks, claws or other extensions extending inwardly from the interior surface 62 of the adjustable retainer 50. The mechanical capturing device 64 may be bonded or affixed to the interior surface 62, or formed as a unitary part thereof. The characteristics of the mechanical capturing device 64 of the interior structure 52/54 in combination with the surface characteristics of the strand 12 determine the extent of the resistance to movement of the adjustable retainer 50 on the strand 12.

Figure 6:
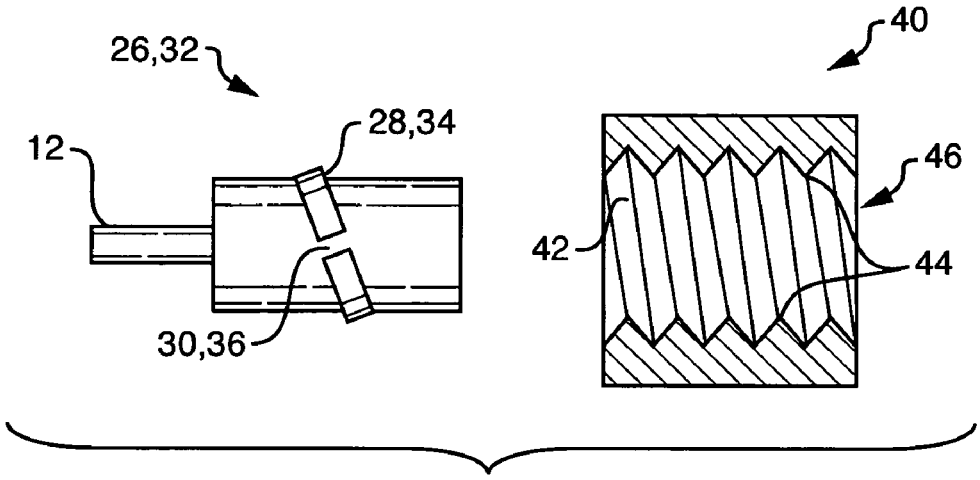
FIG. 6 is a side view of an end connector of the present invention showing the slotted connector body and in proximity to a cross sectional view of a bead with threaded port.

FIG. 6 illustrates either or both of the first bead blocker 26 and the second bead blocker 32, with flange 28/34 and slot 30/36 spaced from an internally threaded bead 40 in cross section to be placed on strand 12. The bead 40 includes a bead port 42 and threading 44. The bead port 42 has dimensions greater than the body of the bead blocker 26/32 except at the flange 28/34. Flange 28/34 has dimensions sufficient to block passage of the bead 40 thereover. However, the slot 30/36 of the bead blocker 26/32 is positioned in combination with the position of the flange 28/34 in an angled alignment that permits the wearer to thread the threads 44 of the bead 40 thereon. As a result, only when an end 46 of the threaded bead 40 passes beyond the flange 28/34 and slot 30/36, the bead 40 may be moved onto the strand 12. The bead 40 may be removed from the strand 12 by reversing the process. This arrangement of the flange 28/34 and slot 30/36 allows placement of existing and new threaded beads 40 onto the strand 12 of the jewelry piece 10 of the present invention.

Figure 7:
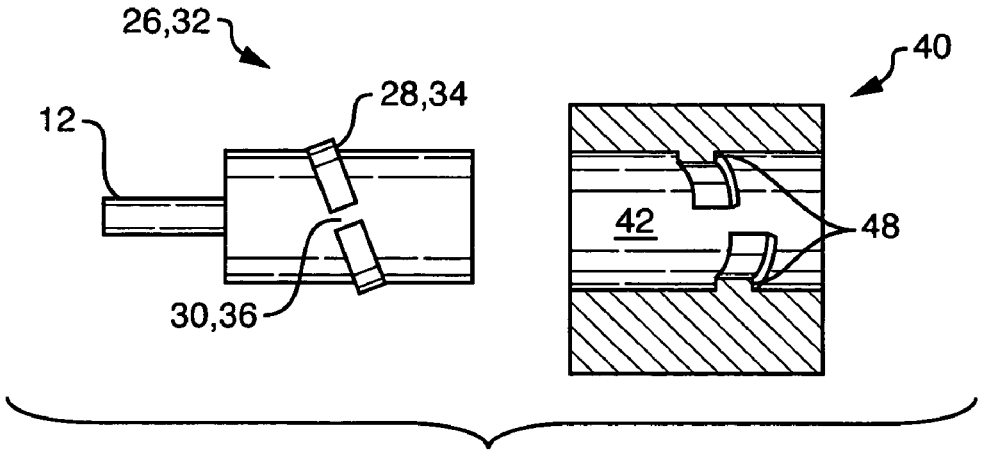
FIG. 7 is a side view of an end connector of the present invention showing the slotted connector body and in proximity to a cross sectional view of a bead with flanged port.

FIG. 7 illustrates either or both of the first bead blocker 26 and the second bead blocker 32, with flange 28/34 and slot 30/36 spaced from an internally flanged bead 40 in cross section to be placed on strand 12. The bead 40 includes a bead port 42 and bead flange 48. The bead port 42 has dimensions greater than the body of the bead blocker 26/32 except at the flange 28/34. Flange 28/34 has dimensions sufficient to block passage of the bead 40 thereover. However, the slot 30/36 of the bead blocker 26/32 is positioned in combination with the position of the flange 28/34 to correspond with the alignment of the bead flange 48 of the bead 40. When the bead flange 48 is aligned with the slot 30/36, the bead 40 will pass over the bead blocker 26/32 and onto the strand 12. The process may be reversed to remove the bead 40 from the strand 12. This arrangement of the flange 28/34 and slot 30/36 allows easy placement of a bead 40 on the strand without the need to thread the bead entirely to get it onto the strand 12. It also ensures that the bead 40 will not pass over the bead blocker 26/32 without direct alignment of the bead flange 48 and the slot 30/36. It is to be understood that the end connector 14/20 of the present invention including the bead blocker 26/32 may be used with beads 40 having bead ports 42 with dimensions greater than the flange 28/34; however, an adjustable retainer 50 is to be placed between the bead 40 and the end connector 14/20 to prevent the bead 40 from unintended passing over the end connector 14/20, as when the loops 16/22 are not engaged.

While the present invention has been described with particular reference to certain embodiments of the modifiable jewelry piece 10, it is to be understood that it includes all reasonable equivalents thereof as defined by the following appended claims.

What is claimed is:

1. A modifiable jewelry piece comprising:

a. a strand having an outer surface and a length;

b. one or more beads placeable around the strand, wherein the one or more beads may be positioned at selectable positions along the length of the strand and wherein the one or more beads are not affixed to the strand;

c. one or more adjustable retainers, each having interior dimensions, wherein each of the one or more adjustable retainers may be removably applied around the strand at any position along the length of the strand to restrict movement of the one or more beads along the strand, wherein each of the one or more adjustable retainers includes an interior structure configured to establish direct frictional engagement with the outer surface of the strand without a fixed component between the strand and the interior structure of the retainer, wherein the interior structure covers substantially all of the inside dimensions of the adjustable retainer such that substantially all of the interior structure is in contact with the strand when the retainer is positioned on the strand, and wherein the interior structure is arranged to substantially restrict movement of the retainer along the strand and rotational movement of the retainer around the strand when the retainer is positioned on the strand; and d. an end connector including a bead blocker with a flange and a slot, wherein one or more of the one or more beads is internally threaded and the slot of the bead blocker aligns with the internal threading of the one or more beads.

2. The modifiable jewelry piece as claimed in claim 1 wherein the interior structure of the adjustable retainer is a solid or semi-solid material having high surface tension characteristics.

3. The modifiable jewelry piece as claimed in claim 2 wherein the solid or semi-solid material is a viscoelastic material.

4. The modifiable jewelry piece as claimed in claim 1 wherein the interior structure of the adjustable retainer is a mechanical capturing device.

5. The modifiable jewelry piece as claimed in claim 1 wherein the adjustable retainer is a unitary structure.

6. The modifiable jewelry piece as claimed in claim 1 wherein the adjustable retainer is a two-piece hinged structure.

7. A modifiable jewelry piece comprising:

a. a strand having an outer surface and a length;

b. one or more beads placeable around the strand, wherein the one or more beads may be positioned at selectable positions along the length of the strand and wherein the one or more beads are not affixed to the strand;

c. one or more adjustable retainers, each having interior dimensions, wherein each of the one or more adjustable retainers may be removably applied around the strand at any position along the length of the strand to restrict movement of the one or more beads along the strand, wherein each of the one or more adjustable retainers includes an interior structure configured to establish direct frictional engagement with the outer surface of the strand without a fixed component between the strand and the interior structure of the retainer, wherein the interior structure covers substantially all of the inside dimensions of the adjustable retainer such that substantially all of the interior structure is in contact with the strand when the retainer is positioned on the strand, and wherein the interior structure is arranged to substantially restrict movement of the retainer along the strand and rotational movement of the retainer around the strand when the retainer is positioned on the strand; and d. an end connector including a bead blocker with a flange and a slot, wherein one or more of the one or more beads is internally flanged and the slot of the bead blocker aligns with the internal flange of the one or more beads.

8. The modifiable jewelry piece as claimed in claim 7 wherein the interior structure of the adjustable retainer is a solid or semi-solid material having high surface tension characteristics.

9. The modifiable jewelry piece as claimed in claim 8 wherein the solid or semi-solid material is a viscoelastic material.

10. The modifiable jewelry piece as claimed in claim 7 wherein the interior structure of the adjustable retainer is a mechanical capturing device.

11. The modifiable jewelry piece as claimed in claim 7 wherein the adjustable retainer is a unitary structure.

12. The modifiable jewelry piece as claimed in claim 7 wherein the adjustable retainer is a two-piece hinged structure.

* * * * *